US008472849B2

(12) United States Patent
Tanaka

(10) Patent No.: US 8,472,849 B2
(45) Date of Patent: Jun. 25, 2013

(54) TONER CARTRIDGE AND IMAGE FORMING APPARATUS HAVING TONER CARTRIDGE

(71) Applicant: Yoshiaki Tanaka, Numazu (JP)

(72) Inventor: Yoshiaki Tanaka, Numazu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/683,539

(22) Filed: Nov. 21, 2012

(65) Prior Publication Data

US 2013/0078005 A1 Mar. 28, 2013

Related U.S. Application Data

(63) Continuation of application No. 13/333,895, filed on Dec. 21, 2011, now Pat. No. 8,320,802, which is a continuation of application No. 12/202,074, filed on Aug. 29, 2008, now Pat. No. 8,099,029.

(60) Provisional application No. 60/969,915, filed on Sep. 4, 2007.

(51) Int. Cl.
*G03G 15/08* (2006.01)

(52) U.S. Cl.
USPC ..... 399/263

(58) Field of Classification Search
USPC ..... 399/254–256, 258, 262, 263; 222/DIG. 1
See application file for complete search history.

(56) References Cited

U.S. PATENT DOCUMENTS

| | | | |
|---|---|---|---|
| 4,937,625 | A | 6/1990 | Kato et al. |
| 5,122,834 | A | 6/1992 | Okamoto et al. |
| 5,835,827 | A | 11/1998 | Kishimoto |
| 6,115,574 | A | 9/2000 | Mikuriya |
| 6,324,369 | B1 | 11/2001 | Yamaguchi et al. |
| 6,405,010 | B2 | 6/2002 | Ashikari et al. |
| 6,795,660 | B2 | 9/2004 | Yugeta et al. |
| 7,031,644 | B2 | 4/2006 | Ikeda et al. |
| 7,072,606 | B2 | 7/2006 | Fujii et al. |
| 7,155,149 | B2 | 12/2006 | Fujii et al. |
| 7,515,853 | B2 | 4/2009 | Kimura et al. |
| 7,558,514 | B2 | 7/2009 | Yamamura |
| 7,831,175 | B2 | 11/2010 | Moon et al. |
| 7,873,305 | B2 | 1/2011 | Moon et al. |

(Continued)

FOREIGN PATENT DOCUMENTS

| | | |
|---|---|---|
| CN | 1577152 | 2/2005 |
| EP | 1953605 | 8/2008 |

(Continued)

OTHER PUBLICATIONS

European Search Report for Application No. EP 08 29 0807 dated Apr. 20, 2009.

(Continued)

*Primary Examiner* — Robert Beatty
(74) *Attorney, Agent, or Firm* — Patterson & Sheridan, LLP

(57) ABSTRACT

A toner cartridge has first and second toner housing portions configured to house toner. The first toner housing portion has a first bottom part that is arcuately curved. The second toner housing portion has a second bottom part that is arcuately curved. The second bottom part is next to the first bottom part and is situated at a position lower than the first bottom part. A third bottom part is provided between the first bottom part and the second bottom part. The third bottom part has a toner discharge port.

11 Claims, 8 Drawing Sheets

U.S. PATENT DOCUMENTS

| | | | |
|---|---|---|---|
| 7,881,643 | B2 | 2/2011 | Lee |
| 2006/0045573 | A1 | 3/2006 | Yamaguchi et al. |
| 2009/0060588 | A1 | 3/2009 | Tanaka |

FOREIGN PATENT DOCUMENTS

| | | |
|---|---|---|
| JP | 60-0221778 | 11/1985 |
| JP | 4-319975 | 11/1992 |
| JP | 05040407 | 2/1993 |
| JP | 2001-042617 | 2/2001 |
| JP | 2005-091715 | 4/2005 |
| JP | 2005-114933 | 4/2005 |
| JP | 2006-099043 | 4/2006 |
| JP | 2007-310146 | 11/2007 |

OTHER PUBLICATIONS

Japanese Office Action dated Oct. 23, 2009, Japanese Application No. 10-2008-86536 with English translation.

Chinese Office Action dated Mar. 29, 2010 filed in corresponding Chinese Patent Application No. 200810214339.6.

Japanese Office Action dated Jan. 24, 2012, filed in corresponding Japanese Application No. 2008-225041 with English translation.

TONER CARTRIDGE AND IMAGE FORMING APPARATUS HAVING TONER CARTRIDGE

CROSS-REFERENCE TO RELATED APPLICATION

This application is a continuation of U.S. patent application Ser. No. 13/333,895, filed Dec. 21, 2011, which is a continuation of U.S. patent application Ser. No. 12/202,074, filed Aug. 29, 2008, now U.S. Pat. No. 8,099,029 which issued on Jan. 17, 2012, which claims the benefit of U.S. Provisional Application No. 60/969,915, filed Sep. 4, 2007. The entire contents of which are incorporated herein by reference.

TECHNICAL FIELD

The present invention relates to a toner cartridge having two toner housing portions. The invention also relates to an image forming apparatus having a toner cartridge that supplies toner to a developing device.

BACKGROUND

An image forming apparatus, for example, a color copy machine or printer, has a toner cartridge to supply toner to a developing device. The toner cartridge is removably attached to a cartridge housing portion of the image forming apparatus. A user can easily replace the toner cartridge when toner in the toner cartridge is used up.

For example, a toner cartridge disclosed in Japanese Patent Publication (KOKAI) No. 2007-310146 has an elongated cylindrical cartridge body that houses toner, a stirring member housed within the cartridge body, and a screw arranged at the bottom of the cartridge body. The cartridge body has a filling port from which toner is put into the cartridge body, and a discharge port from which the toner is discharged toward the developing device. The stirring member rotates in the cartridge body and thereby stirs the toner. The screw rotates in the cartridge body and thereby moves the toner toward the discharge port.

In the toner cartridge of this type, it is desirable that the quantity of toner filling is increased, thereby reducing the frequency of replacing the toner cartridge. As an attempt to increase the quantity of toner filling, two toner housing portions are formed within the cartridge body. When the two toner housing portions are arrayed in the direction of the width of the cartridge body, the height (depth) of the toner housing portions can be increased to secure a sufficient quantity of toner filling.

The cartridge housing portion in which the toner cartridge is loaded is arranged next to principal components of the image forming apparatus such as an image forming unit and a carrying path for carrying a sheet. Therefore, depending on the type of the image forming apparatus, the height of the cartridge housing portion may be limited by a component that is arranged next to the cartridge housing portion. If the height of the cartridge housing portion is limited, the height of the two toner housing portions in the toner cartridge is limited as well. This obstructs increase in the volume of the toner cartridge.

SUMMARY

It is an object of the invention to provide a toner cartridge in which the quantity of toner filling can be increased within a limited height range, thereby enabling reduction in the frequency of replacement.

It is another object of the invention to provide an image forming apparatus having a toner cartridge in which the quantity of toner filling can be increased within a limited height range, thereby enabling reduction in the frequency of replacement.

To achieve the above objects, a toner cartridge according an aspect of the invention includes first and second toner housing portions configured to house toner. The first toner housing portion has a first bottom part that is arcuately curved. The second toner housing portion has a second bottom part that is arcuately curved. The second bottom part is next to the first bottom part and is situated at a position lower than the first bottom part. A third bottom part is provided between the first bottom part and the second bottom part. The third bottom part has a toner discharge port.

To achieve the above objects, an image forming apparatus according to another aspect of the invention includes an image forming unit having a developing device, and a toner cartridge that supplies toner to the developing device. The toner cartridge has first and second toner housing portions configured to house toner. The first toner housing portion has a first bottom part that is arcuately curved. The second toner housing portion has a second bottom part that is arcuately curved. The second bottom part is next to the first bottom part and is situated at a position lower than the first bottom part. A third bottom part is provided between the first bottom part and the second bottom part. The third bottom part has a toner discharge port.

According to the invention, it is possible to increase the quantity of toner filling within a limited height range by changing the height (depth) of the first and second toner housing portions. Therefore, the frequency of replacing the toner cartridge can be reduced and maintenance of the image forming apparatus can be made easier.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

An embodiment of the invention will be described with reference to FIG. 1 to FIG. 10.

Figure 1:
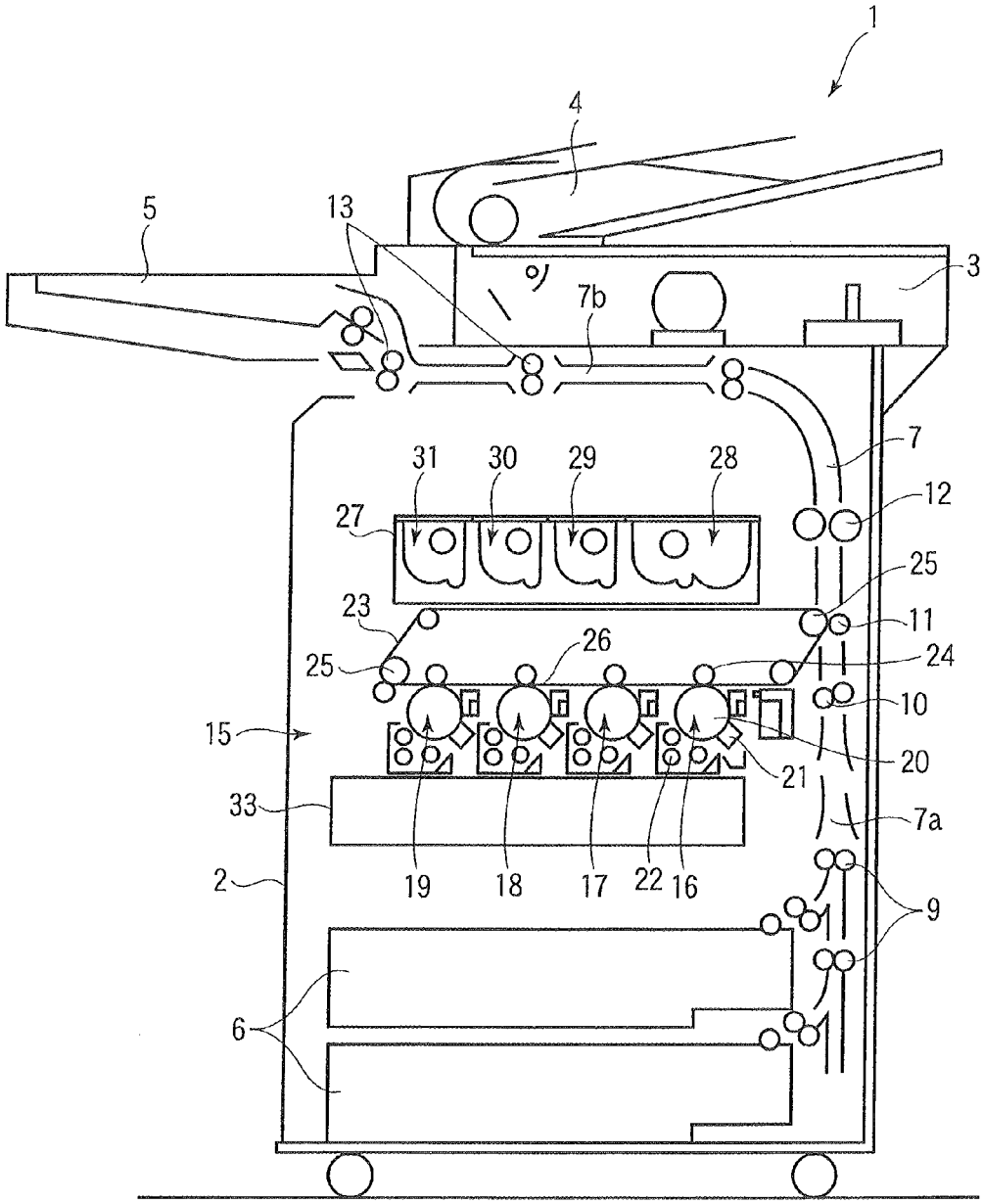
FIG. 1 is an exemplary side view schematically showing an image forming apparatus according to an embodiment of the invention.

FIG. 1 schematically shows an image forming apparatus 1 such as a four-drum tandem color copy machine. The image forming apparatus 1 has an apparatus body 2. In an upper part of the apparatus body 2, a scanner 3 that optically scans image information such as characters from an original, an automatic document feeder 4 that automatically sends the original into the scanner 3, and a sheet discharge tray 5 are provided.

In a lower part of the apparatus body 2, plural sheet feeding cassettes 6 are provided. The sheet feeding cassettes 6 are connected to the sheet discharge tray 5 via a carrying path 7. The carrying path 7 is to guide sheets housed in the sheet feeding cassettes 6, one by one to the sheet discharge tray 5. The carrying path 7 has a first path 7*a* extending upward from the sheet feeding cassettes 6, and a second path 7*b* extending horizontally from the upper edge of the first path 7*a* toward the sheet discharge tray 5. Below the first path 7*a*, plural sheet feeding rollers 9, registration roller 10, a transfer roller 11 and a fixing unit 12 are provided in order. In the second path 7*b*, plural sheet discharge rollers 13 are provided.

As shown in FIG. 1, an image forming section 15 is provided in a middle stage of the apparatus body 2. The image forming section 15 has a first image forming unit 16 for forming a black image, a second image forming unit 17 for forming a cyan image, a third image forming unit 18 for forming a magenta image, and a fourth image forming unit 19 for forming a yellow image. The first to fourth image forming units 16 to 19 are horizontally arrayed in a line along the direction of the width of the apparatus body 2.

Each of the first to fourth image forming units 16 to 19 has a photoconductive drum 20, a charger 21 that uniformly charges the outer circumferential surface of the photoconductive drum 20, a developing device 22 that develops, with toner, an electrostatic latent image formed on the outer circumferential surface of the photoconductive drum 20, and an intermediate transfer roller 24 that transfers the toner image on the photoconductive drum 20 to an intermediate transfer belt 23. The charger 21, the developing device 22 and the intermediate transfer roller 24 are arranged to surround the photoconductive drum 20.

The intermediate transfer belt 23 is endlessly laid over plural rollers 25 and is provided above the first to fourth image forming units 16 to 19. The intermediate transfer belt 23 has a horizontal traveling part 26 that horizontally travels along the arraying direction of the first to fourth image forming units 16 to 19. The horizontal traveling part 26 passes between the photoconductive drums 20 and the intermediate transfer rollers 24 of the first to fourth image forming units 16 to 19. Moreover, the intermediate transfer belt 23 is pressed to the transfer roller 11 on the carrying path 7 via one roller 25.

As shown in FIG. 1, the apparatus body 2 has a cartridge housing portion 27. The cartridge housing portion 27 is provided between the second path 7*b* of the carrying path 7 and the intermediate transfer belt 23. The cartridge housing portion 27 tends to have a strict limitation on its height, depending on the type of the image forming apparatus 1.

First to fourth toner cartridges 28, 29, 30 and 31 are removably housed in the cartridge housing portion 27. The first toner cartridge 28 supplies black toner to the developing device 22 of the first image forming unit 16. The second toner cartridge 29 supplies cyan toner to the developing device 22 of the second image forming unit 17. The third toner cartridge 30 supplies magenta toner to the developing device 22 of the third image forming unit 18. The fourth toner cartridge 31 supplies yellow toner to the developing device 22 of the fourth image forming unit 19.

A laser unit 33 is provided below the first to fourth image forming units 16 to 19. The laser unit 33 casts light corresponding to image information to the photoconductive drums 20 of the first to fourth image forming units 16 to 19. Consequently, electrostatic latent images in the colors to be developed are formed on the outer circumferential surfaces of the photoconductive drums 20 of the first to fourth image forming units 16 to 19.

In the image forming apparatus 1 as described above, the electrostatic latent images formed on the outer circumferential surfaces of the photoconductive drums 20 of the first to fourth image forming units 16 to 19 are developed by toner of desired colors by the developing devices 22 and thus visualized as toner images. The toner images of the four colors formed by the first to fourth image forming units 16 to 19 are sequentially transferred to the intermediate transfer belt 23 via the intermediate transfer rollers 24 and superimposed on this intermediate transfer belt 23.

When the superimposition of the toner images of the four colors on the intermediate transfer belt 23 is completed, a sheet supplied from one sheet feeding cassette 6 to the first path 7*a* of the carrying path 7 is guided to the position of the intermediate transfer belt 23 via the registration roller 10. Thus, the toner images of the four colors superimposed on the intermediate transfer belt 23 are transferred to the sheet via the transfer roller 11. The full-color image transferred to the sheet is fixed to the sheet by the fixing unit 12. The sheet having the full-color image fixed thereto is guided to the sheet discharge tray 5 through the second path 7*b* of the carrying path 7.

Next, the first to fourth toner cartridges 28 to 31 that supply toner to the first to fourth image forming units 16 to 19 will be described. The second to fourth toner cartridges 29 to 31 have a configuration similar to the toner cartridge disclosed in the Japanese Patent Publication (KOKAI) No. 2007-310146. Therefore, the second to fourth toner cartridges 29 to 31 will not be described further in detail.

The first toner cartridge 28, which houses black toner, consumes the toner more quickly than the second to fourth toner cartridges 29 to 31. Therefore, the first toner cartridge 28 employs a configuration to increase the quantity of toner filling in order to reduce the replacement frequency. Hereinafter, the first toner cartridge 28 will be described in detail.

As shown in FIG. 2 to FIG. 5, the first toner cartridge 28 has a cartridge body 35 that is made of synthetic resin. The cartridge body 35 is in the form of an elongated box having a long axis L1 along the direction of the depth of the image forming apparatus 1 and a short axis S1 along the direction of the width of the image forming apparatus 1. The cartridge body 35 is removably inserted into the cartridge housing portion 27 from the front side of the image forming apparatus 1.

The cartridge body 35 includes a container 36 and a top cover 37. The container 36 is in the form of an elongated box having left and right side walls 38*a* and 38*b*, a bottom wall 39, a rear wall 40, a front wall 41 and an opening 42. The side walls 38*a* and 38*b* extend along the long axis L1 of the cartridge body 35 and face each other in the direction of the short axis S1. The bottom wall 39 is laid between the lower edge of the side wall 38*a* and the lower edge of the side wall 38*b*. The rear wall 40 is situated at one end along the direction of the long axis L1 of the cartridge body 35. The front wall 41 is situated at the other end along the direction of the long axis L1 of the cartridge body 35. The opening 42 has a rectangular opening shape prescribed by the upper edges of the side walls 38*a* and 38*b*, the upper edge of the rear wall 40 and the upper edge of the front wall 41, and faces the bottom wall 39.

When the cartridge body 35 is inserted into the cartridge housing portion 27 of the image forming apparatus 1, the rear wall 40 of the cartridge body 35 faces a coupling, not shown, that is situated at the terminal end of the cartridge housing portion 27. The coupling is driven by a driving device provided in the apparatus body 2 of the image forming apparatus 1.

The top cover 37 seals the opening 42 of the container 36. The top cover 37, in cooperation with the container 36, forms a toner receptacle 43 for housing black toner inside the cartridge body 35. The top cover 37 has a flat inner surface 37*a* that is exposed to the toner receptacle 43.

Figure 2:
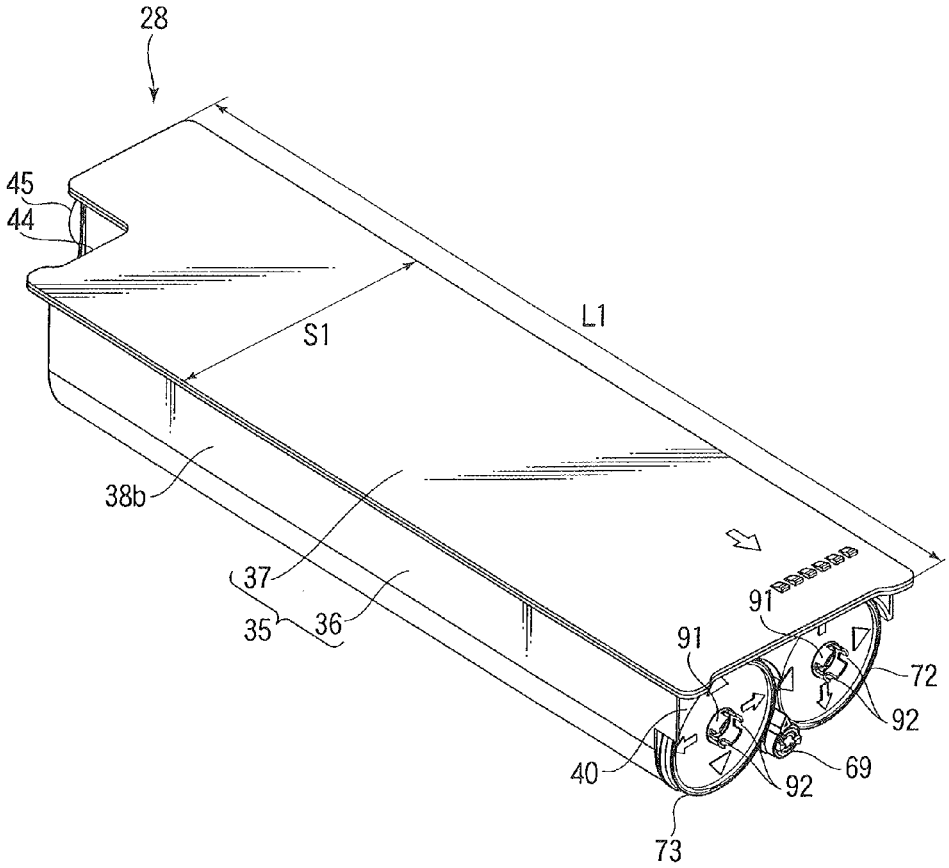
FIG. 2 is an exemplary perspective view of a toner cartridge according to the embodiment of the invention.
Figure 3:
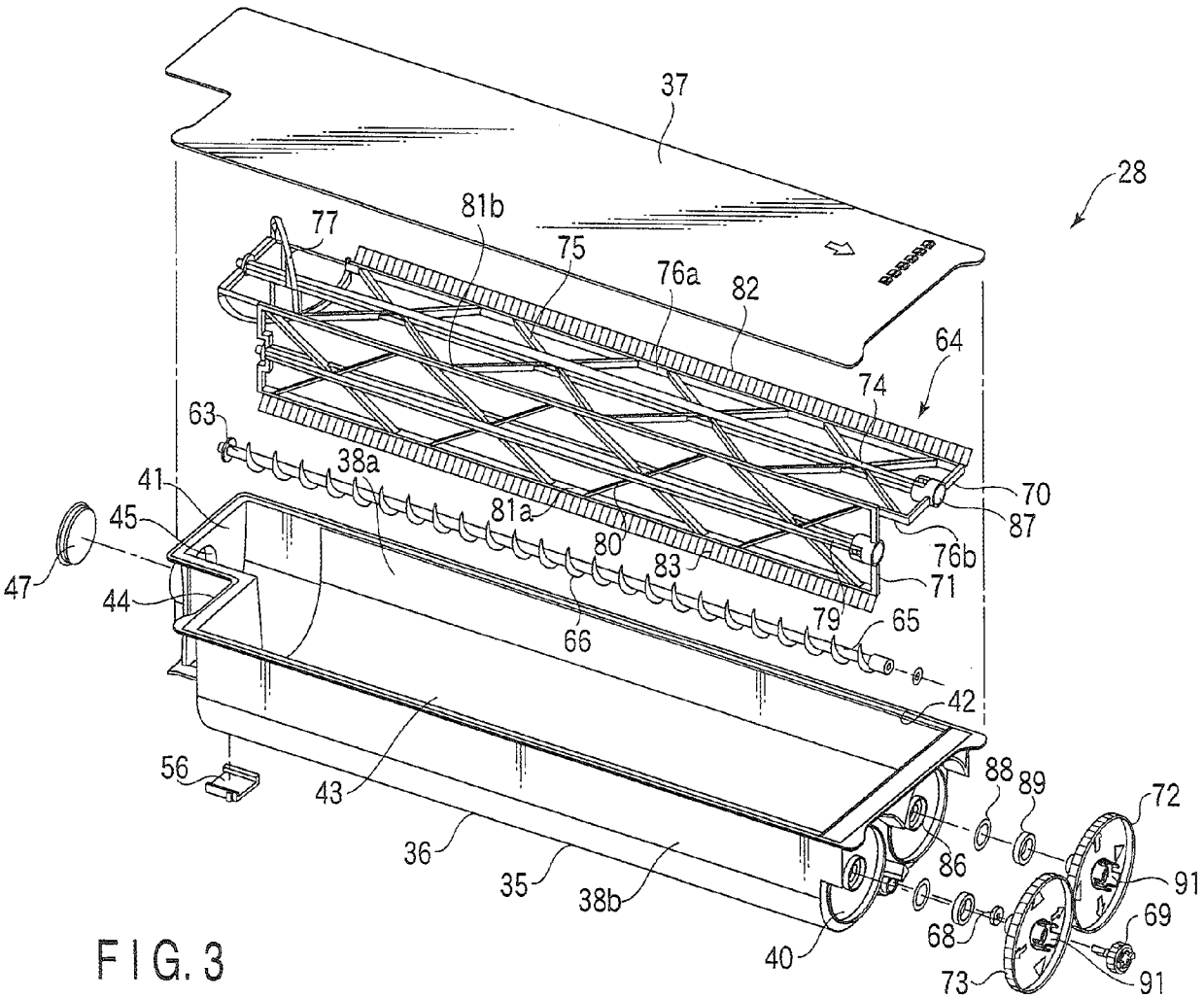
FIG. 3 is an exemplary exploded perspective view of the toner cartridge according to the embodiment of the invention.
Figure 4:
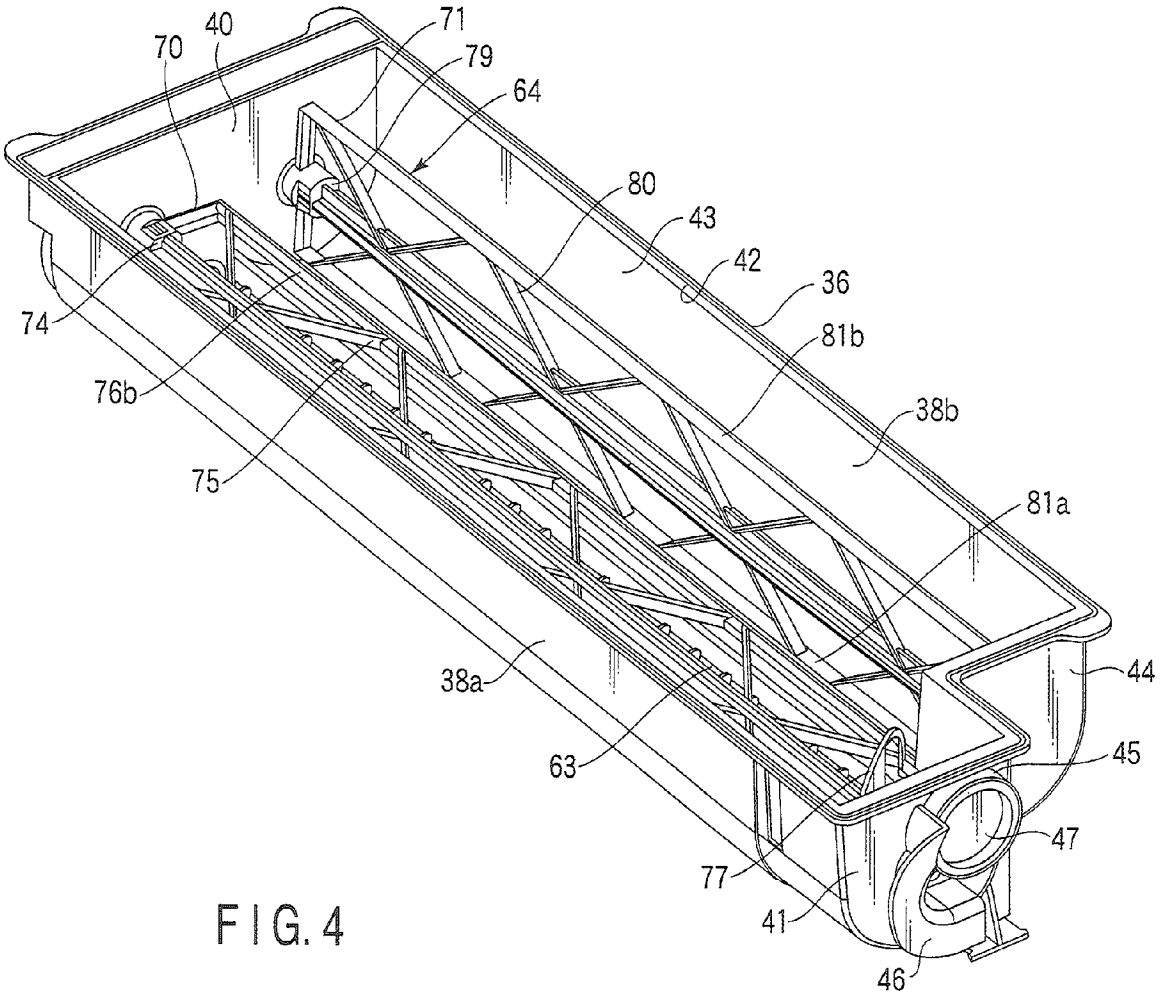
FIG. 4 is an exemplary perspective view of a container that houses a pair of stirring members and a screw in the embodiment of the invention.

As shown in FIG. 2 to FIG. 4, a concave 44 is formed in the front wall 41 of the container 36. The concave 44 is recessed from the front wall 41 toward the rear wall 40. Therefore, the front end part of the cartridge body 35 is formed stepwise.

A filling port 45 and a handle 46 are formed in the front wall 41 of the container 36. The filling port 45 is for filling the toner receptacle 43 with black toner and is arranged next to the concave 44. The filling port 45 is sealed by a cap 47 after toner filling is completed. The handle 46 is for a user to hook a finger on when pulling the cartridge body 35 out of the cartridge housing portion 27. The handle 46 is situated on the periphery of the filling port 45 and protrudes from the front wall 41 into the direction of the long axis L1 of the cartridge body 35.

Figure 5:
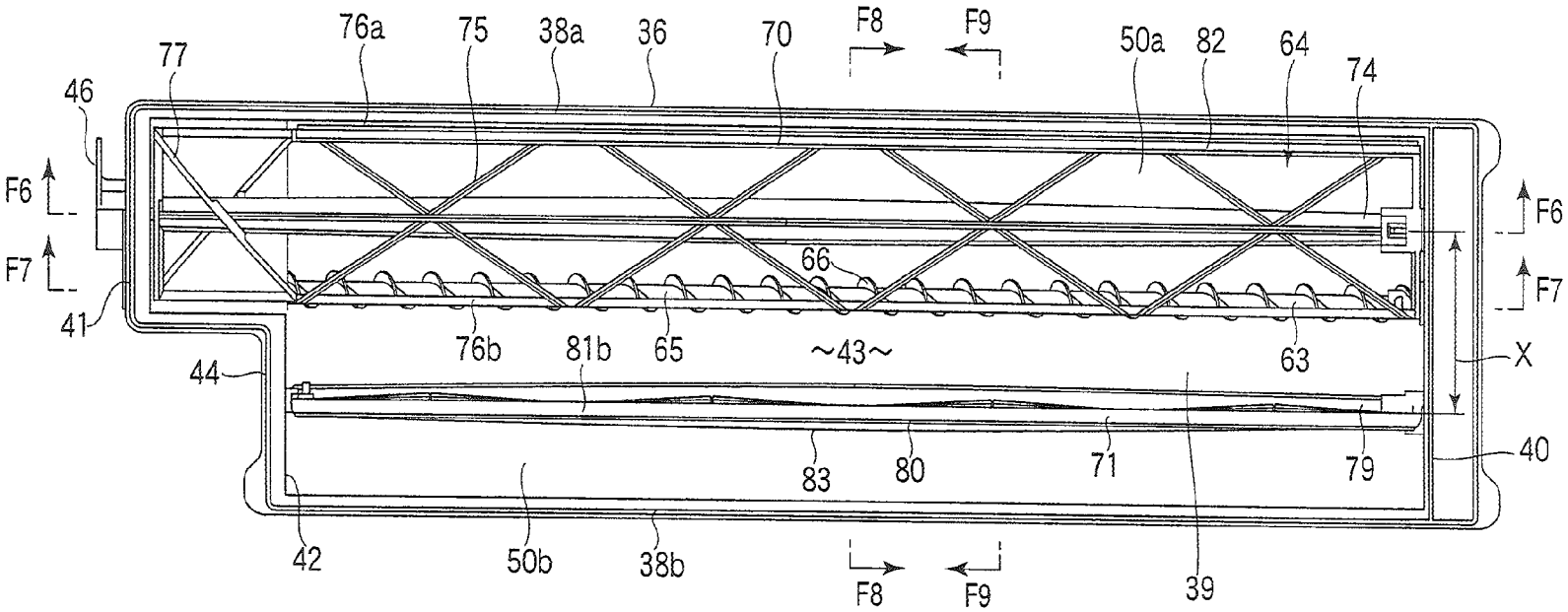
FIG. 5 is an exemplary plan view of the container that houses a pair of stirring members and the screw in the embodiment of the invention.
Figure 8:
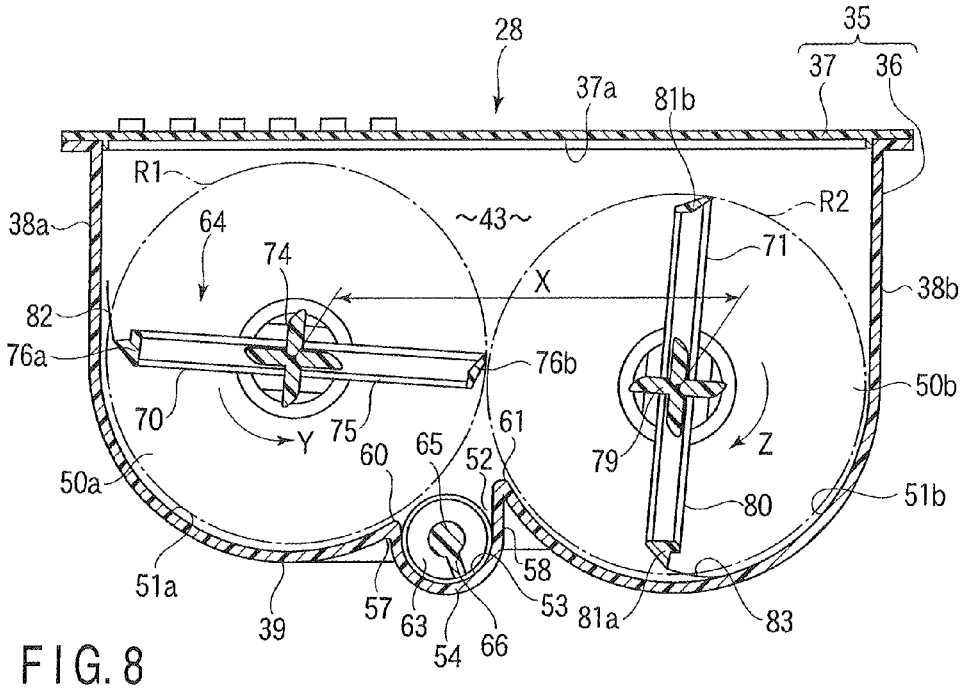
FIG. 8 is an exemplary sectional view taken along a line F8-F8 of FIG. 5.
Figure 9:
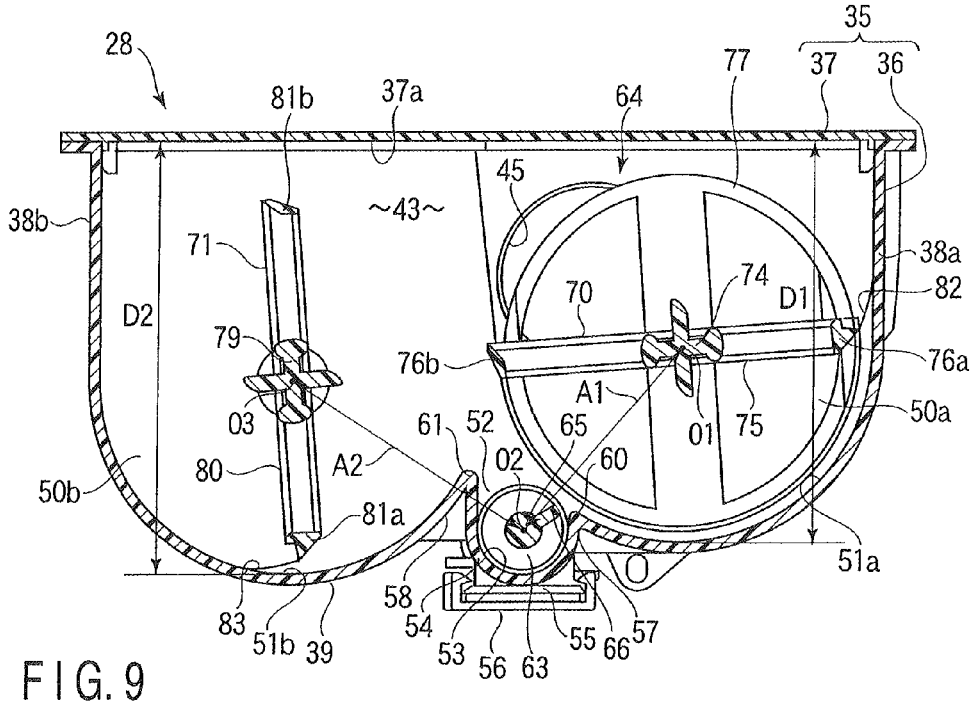
FIG. 9 is an exemplary sectional view taken along a line F9-F9 of FIG. 5.

As shown in FIG. 5, FIG. 8 and FIG. 9, the toner receptacle 43 has a first toner housing portion 50*a* and a second toner housing portion 50*b*. The first and second toner housing portions 50*a* and 50*b* extend along the long axis L1 of the cartridge body 35 and are arrayed side by side in the direction of the short axis S1 of the cartridge body 35. The filling port 45 of the container 36 is open at the front end of the first toner housing portion 50*a*. The concave 44 of the container 36 is situated at the front end of the second toner housing portion 50*b*. Therefore, the second toner housing portion 50*b* is shorter than the first toner housing portion 50*a* by the size of the concave 44, in the direction of the long axis L1 of the cartridge body 35.

As shown in FIG. 8 and FIG. 9, the bottom wall 39 of the container 36 has a first bottom part 51*a* that serves as the bottom of the first toner housing portion 50*a*, and a second bottom part 51*b* that serves as the bottom of the second toner housing portion 50*b*. The first and second bottom parts 51*a* and 51*b* are next to each other and are arcuately curved to expand downward of the container 36. The second bottom part 51*b* further expands downward of the container 36 than the first bottom part 51*a*. According to this embodiment, the first bottom part 51*a* and the second bottom part 51*b* have the same curvature.

Consequently, the depth D1 of the first toner housing portion 50*a* is prescribed between the inner surface 37*a* of the top cover 37 and the lowest part of the first bottom part 51*a*. Similarly, the depth D2 of the second toner housing portion 50*b* is prescribed between the inner surface 37*a* of the top cover 37 and the lowest part of the second bottom part 51*b*. The depth D2 of the second toner housing portion 50*b* is larger than the depth D1 of the first toner housing portion 50*a*.

In other words, the part of the cartridge body 35 corresponding to the first toner housing portion 50*a* and the part of the cartridge body 35 corresponding to the second toner housing portion 50*b* have different heights from each other. Thus, despite the length of the second toner housing portion 50*b* that is shorter by the size of the concave 44 of the container 36, the second toner housing portion 50*b* can be securely filled with a sufficient quantity of toner.

As shown in FIG. 8 and FIG. 9, the container 36 has a toner carrying portion 52. The toner carrying portion 52 is prescribed by a groove 53 formed in the bottom wall 39 of the container 36. The groove 53 is provided between the first bottom part 51*a* of the first toner housing portion 50*a* and the second bottom part 51*b* of the second toner housing portion 50*b* and extends straight along the direction of the long axis L1 of the cartridge body 35. The groove 53 is open to the toner receptacle 43.

The bottom wall 39 of the container 36 has a third bottom part 54 that serves as the bottom of the toner carrying portion 52. The third bottom part 54 is arcuately curved to expand downward of the container 36 and expands downward of the container 36, much below the first and second bottom parts 51*a* and 51*b*.

The third bottom part 54 has a toner discharge port 55 as shown in FIG. 9. The toner discharge port 55 is for discharging the toner filled in the toner receptacle 43, to outside of the cartridge body 35. The toner discharge port 55 is provided at a position next to the front wall 41 of the container 36 and is opened and closed by a shutter 56.

When the bottom wall 39 of the container 36 is viewed from outside of the container 36, the boundary between the first bottom part 51*a* and the third bottom part 54 is prescribed by a first recess 57. Similarly, the boundary between the second bottom part 51*b* and the third bottom part 54 is prescribed by a second recess 58. The first and second recesses 57 and 58 are open downward of the container 36 and extend straight along the direction of the long axis L1 of the cartridge body 35.

When the bottom wall 39 of the container 36 is viewed from inside of the container 36, the first recess 57 forms a first protrusion 60 protruding upward from the bottom wall 39. Similarly, the second recess 58 forms a second protrusion 61 protruding upward from the bottom wall 39. The first protrusion 60 extends straight along the long axis L1 of the cartridge body 35 and serves as a partition between the first bottom part 51*a* and the third bottom part 54. The second protrusion 61 extends straight along the long axis L1 of the cartridge body 35 and serves as a partition between the second bottom part 51*b* and the third bottom part 54. The height of the second protrusion 61 in relation to the third bottom part 54 is larger than the height of the first protrusion 60 in relation to the third bottom part 54. The first and second protrusions 60 and 61 face each other with the groove 53 in-between.

As best shown in FIG. 3 to FIG. 5, the first toner cartridge 28 further includes a screw 63 that moves the toner filled in the toner receptacle 43 to the toner discharge port 55, and a stirring mechanism 64 to stir the toner that is filling the toner receptacle 43.

The screw 63 is an exemplary carrying member. The screw 63 has a rotary shaft 65 and a spiral guide blade 66 that is formed on the outer circumferential surface of the rotary shaft 65. As shown in FIG. 8 and FIG. 9, the screw 63 is housed in the groove 53 and is exposed to the bottom of the toner receptacle 43 from between the first protrusion 60 and the second protrusion 61. The screw 63 crosses over the toner discharge port 55. The rotary shaft 65 of the screw 63 is laid between the rear wall 40 and the front wall 41 of the container 36 and thereby rotatably supported to the container 36.

The third bottom part 54 serving as the bottom of the toner carrying portion 52 is curved to follow the rotation locus formed by the outer circumferential edge of the guide blade 66 of the screw 63. Moreover, the lowest part of the second bottom part 51*b* of the second toner housing portion 50*b* is situated at a position lower than the rotary shaft 65 serving as the center of rotation of the screw 63. According to this embodiment, it is desirable that the lowest part of the second bottom part 51*b* is situated at the same height position as the lower end of the outer circumferential edge of the screw 63 or at a position slightly higher than the lower end of the screw 63.

Figure 10:
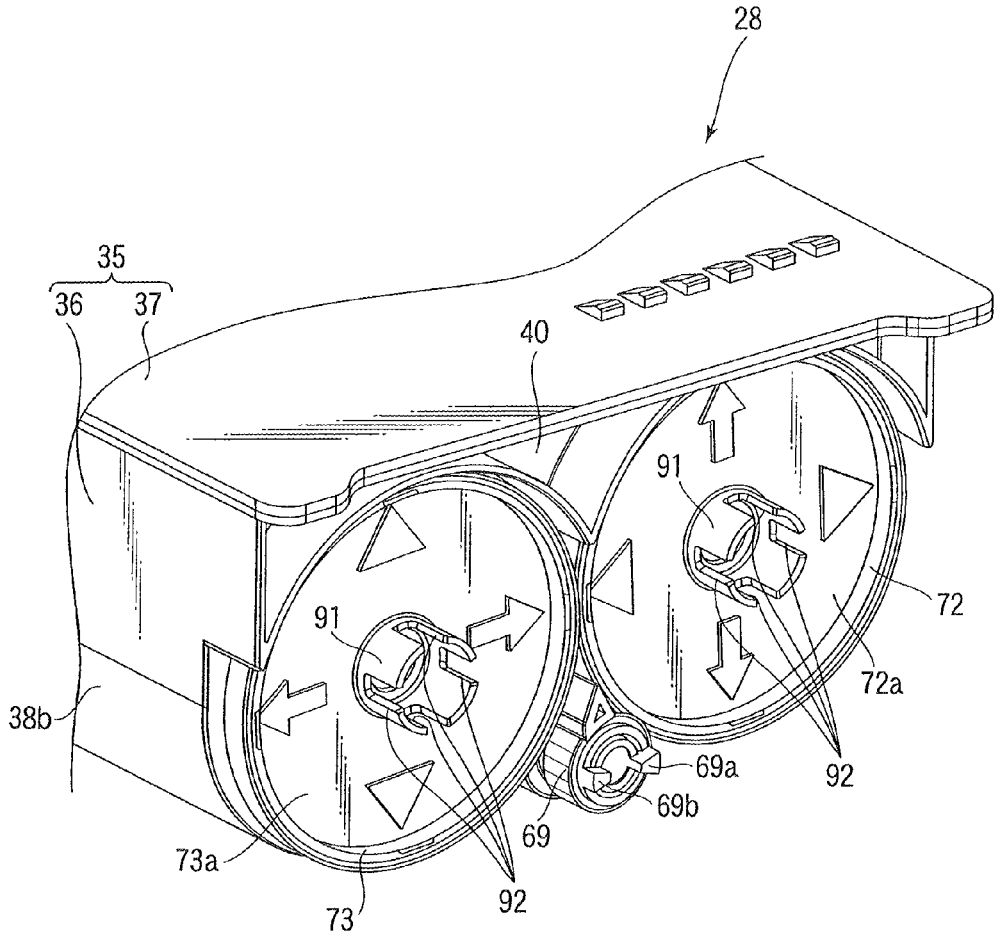
FIG. 10 is an exemplary perspective view of the toner cartridge in the state where a pair of gears mesh with each other in the embodiment of the invention.

At the rear end of the rotary shaft 65 of the screw 63, a driving gear 69 is coaxially fixed via a seal ring 68. The driving gear 69 is situated on the outside of the rear wall 40 of the container 36. As shown in FIG. 10, the driving gear 69 has a pair of engagement protrusions 69*a* and 69*b*. When the first toner cartridge 28 is inserted into the cartridge housing portion 27, the engagement protrusions 69*a* and 69*b* mesh with the coupling in the cartridge housing portion 27. This meshing causes the screw 63 to rotate in response to the torque of the driving device.

The stirring mechanism 64 has first and second stirring members 70 and 71, and first and second gears 72 and 73. The first stirring member 70 is provided in the first toner housing portion 50*a*. The first stirring member 70 includes a rotary shaft 74 and a paddle unit 75. The rotary shaft 74 is laid between the real wall 40 and the front wall 41 of the container 36. The paddle unit 75 is formed by assembling plural bar members into a truss-shape and has two outer frames 76*a* and 76*b* extending in the axial direction of the rotary shaft 74. The outer frames 76*a* and 76*b* are arranged parallel to the rotary shaft 74 and face each other with the rotary shaft 74 in-between. Therefore, the paddle unit 75 has a shape that crosses the rotary shaft 74 in the direction of its diameter.

The first stirring member 70 is supported to the container 36 via the rotary shaft 74 and rotates about the rotary shaft 74. When the first stirring member 70 rotates, the outer frames 76*a* and 76*b* of the paddle unit 75 move, having a small gap to the first bottom part 51*a* of the first toner housing portion 50*a*. Therefore, the first bottom part 51*a* is curved to follow the rotation locus R1 drawn by the outer frames 76*a* and 76*b*.

The paddle unit 75 also has a spiral carrying blade 77. The carrying blade 77 is situated right beside the toner discharge port 55 and delivers toner toward the toner discharge port 55.

The second stirring member 71 is provided in the second toner housing portion 50*b*. The second stirring member 71 includes a rotary shaft 79 and a paddle unit 80. The rotary shaft 79 is laid between the real wall 40 and the concave 44 of the front wall 41 of the container 36. The paddle unit 80 is formed by assembling plural bar members into a truss-shape and has two outer frames 81*a* and 81*b* extending in the axial direction of the rotary shaft 79. The outer frames 81*a* and 81*b* are arranged parallel to the rotary shaft 79 and face each other with the rotary shaft 79 in-between. Therefore, the paddle unit 80 has a shape that crosses the rotary shaft 79 in the direction of its diameter.

The second stirring member 71 is supported to the container 36 via the rotary shaft 79 and rotates about the rotary shaft 79. When the second stirring member 71 rotates, the outer frames 81*a* and 81*b* of the paddle unit 80 move, having a small gap to the second bottom part 51*b* of the second toner housing portion 50*b*. Therefore, the second bottom part 51*b* is curved to follow the rotation locus R2 drawn by the outer frames 81*a* and 81*b*.

The paddle unit 75 of the first stirring member 70 and the paddle unit 80 of the second stirring member 71 have basically the same configuration and have an equivalent length along the radial direction of the rotary shafts 74 and 79. As shown in FIG. 5, the first stirring member 70 and the second stirring member 71 are arranged parallel to each other with spacing in the direction of the short axis S1 of the cartridge body 35. The distance X between the rotary shaft 74 of the first stirring member 70 and the rotary shaft 79 of the second stirring member 71 is set at such a value that the rotating paddle units 75 and 80 do not interfere with each other.

The rotary shaft 79 of the second stirring member 71 is shifted below the rotary shaft 74 of the first stirring member 70. Thus, despite the greater downward expansion of the second bottom part 51*b* of the second toner housing portion 50*b* from the container 36 than the first bottom part 51*a* of the first toner housing portion 50*a*, the spacing between the second bottom part 51*b* and the outer circumferential part of the paddle unit 80 is kept equivalent to the spacing between the first bottom part 51*a* and the outer circumferential part of the paddle unit 75.

Moreover, according to this embodiment, the distance A1 from the center of rotation O1 of the first stirring member 70 to the center of rotation O2 of the screw 63 is shorter than the distance A2 from the center of rotation O3 of the second stirring member 71 to the center of rotation O2 of the screw 63. Therefore, as shown in FIG. 8 and FIG. 9, when the paddle unit 75 of the first stirring member 70 is horizontal, the outer circumferential part of the paddle unit 75 is situated right above the screw 63. In other words, the rotation locus R1 drawn by the outer circumferential part of the first stirring member 70 passes right above the screw 63.

A scraper 82 is attached to one outer frame 76*a* of the first stirring member 70. The scraper 82 extends across the entire length of the paddle unit 75. When the first stirring member 70 rotates, the scraper 82 moves in contact with the first bottom part 51*a* of the first toner housing portion 50*a*.

A scraper 83 is attached to one outer frame 81*a* of the second stirring member 71. The scraper 83 extends across the entire length of the paddle unit 80. When the second stirring member 71 rotates, the scraper 83 moves in contact with the second bottom part 51*b* of the second toner housing portion 50*b*.

As shown in FIG. 10, the first and second gears 72 and 73 are, for example, disc-shaped common components and arranged on the outer side of the rear wall 40 of the container 36. The first gear 72 is coaxially fixed at the rear end of the rotary shaft 74 of the first stirring member 70. The second gear 73 is coaxially fixed at the rear end of the rotary shaft 79 of the second stirring member 71. Since the structures to fix the first and second gears 72 and 73 to the rotary shafts 74 and 79 are common to each other, the fixing structure of the first gear 72 to the rotary shaft 74 will now be described as an exemplary.

Figure 6:
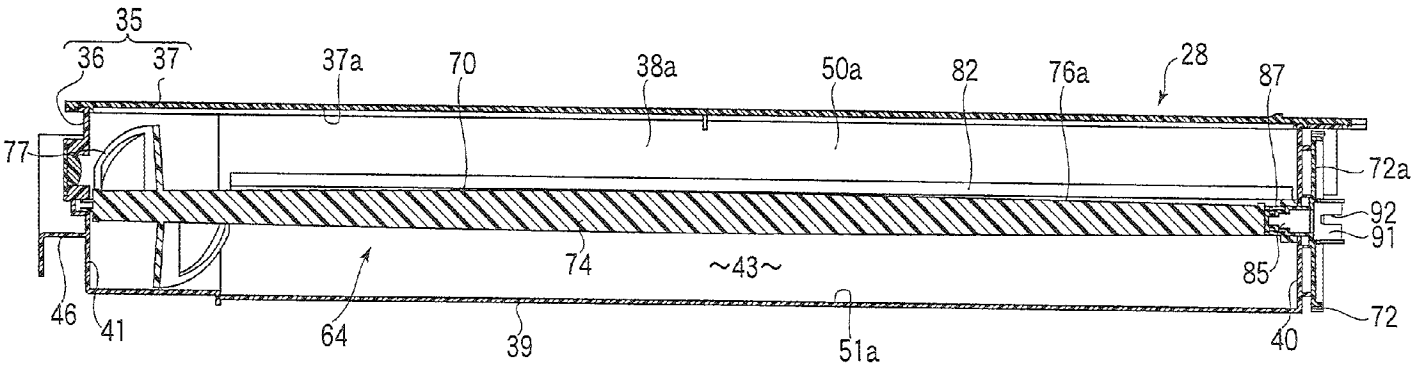
FIG. 6 is an exemplary sectional view taken along a line F6-F6 of FIG. 5.
Figure 7:
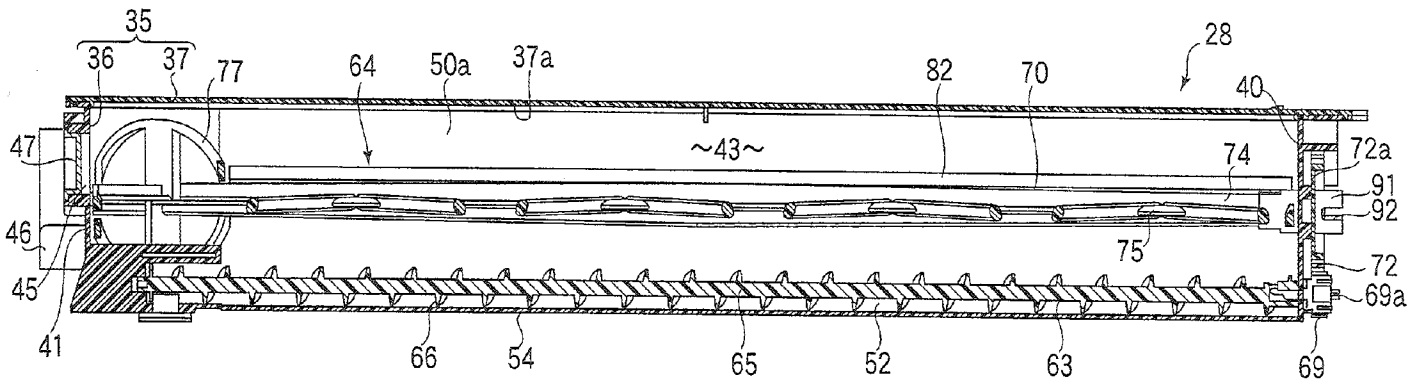
FIG. 7 is an exemplary sectional view taken along a line F7-F7 of FIG. 5.

As shown in FIG. 6, the first gear 72 has a cylindrical fitting part 85 at its center of rotation. The fitting part 85 penetrates a bearing hole 86 opened in the rear wall 40 and is fitted in a fitting hole 87 formed at the rear end of the rotary shaft 74. Thus, the first gear 72 is integrally connected with the rotary shaft 74 and rotates together with this rotary shaft 74. The fitting part 85 penetrates a washer 88 and a seal ring 89. The seal ring 89 is provided between the rear wall 40 and the first gear 72 to prevent leakage of toner from the bearing hole 86.

As shown in FIG. 2 and FIG. 10, the first and second gears 72 and 73 mesh with each other on the outside of the container 36. This meshing causes the first and second stirring members 70 and 71 to rotate synchronously with each other in the opposite directions. In this embodiment, the first stirring member 70 rotates counterclockwise as indicated by an arrow Y in FIG. 8 and the second stirring member 71 rotates clockwise as indicated by an arrow Z in FIG. 8.

When the torque of the driving device of the image forming apparatus 1 is transmitted to the driving gear 69 from the coupling, the screw 63 rotates via the driving gear 69. The driving gear 69 is meshed with the first gear 72. Therefore, the torque of the driving device is transmitted from the driving gear 69 to the first and second stirring members 70 and 71 via the first and second gears 72 and 73, thereby causing the first and second stirring members 70 and 71 to rotate. The first and second stirring members 70 and 71 stir toner in the first and second toner housing portions 50*a* and 50*b* and send out the toner toward the screw 63.

The scrapers 82 and 83 fixed to the first and second stirring members 70 and 71 move in contact with the first and second bottom parts 51*a* and 51*b* of the first and second toner housing portions 50*a* and 50*b*. Therefore, the toner located in the gap between the first and second stirring members 70 and 71 and the first and second bottom parts 51*a* and 51*b* and the toner adhered to the first and second bottom parts 51*a* and 51*b* can be scraped off by the scrapers 82 and 83 into the direction of the screw 63. Thus, the toner filled in the first and second toner housing portions 50*a* and 50*b* can be effectively supplied to the screw 63 without being wasted.

The screw 63 moves the toner sent from the first and second stirring members 70 and 71, toward the toner discharge port 55. The toner moved to the toner discharged port 55 is supplied from the toner discharge port 55 to the developing device 22 of the first image forming unit 16.

As shown in FIG. 10, the first and second gears 72 and 73 have circular end surfaces 72*a* and 73*a* exposed to outside of the cartridge body 35. A cylindrical section 91 is integrally formed at the center part of each of the end surfaces 72*a* and 73*a*. The cylindrical sections 91 coaxially protrude in the direction opposite to the cartridge body 35 from the end surfaces 72*a* and 73*a* of the first and second gears 72 and 73. The cylindrical sections 91 are for optically detecting the type of the first toner cartridge 28, for example, by a technique similar to the technique employed in the toner cartridge disclosed in Japanese Patent Publication (KOKAI) No. 2007-310146.

Specifically, each cylindrical section 91 has four slits 92. The slits 92 extend in the axial direction of the cylindrical section 91 and are arrayed at equal spacing in the circumferential direction of the cylindrical section 91. When the first toner cartridge 28 is inserted into the cartridge housing portion 27 of the image forming apparatus 1, the cylindrical sections 91 coincide with photodetectors (not shown) provided at the terminal end of the cartridge housing portion 27.

As disclosed in the above patent publication, each photodetector includes a light emitting element and a light receiving element. The light emitting element and the light receiving element face each other with spacing. The light emitting element is situated at a rotation center part of the cylindrical section 91. The light receiving element is situated on the outside of the cylindrical section 91.

When the cylindrical section 91 rotates together with the first and second gears 72 and 73, the slits 92 pass between the light emitting element and the light receiving element, one after another. The light receiving element receives light from the light emitting element when the slits 92 exist between the light receiving element and the light emitting element. When the light receiving element receives light from the light emitting element, the photodetector outputs a first signal to a control unit. When light directed toward the light receiving element from the light emitting element is interrupted by the cylindrical section 91, the photodetector outputs a second signal to the control unit.

The control unit detects a time L when the photodetector outputs the first signal and a time H when the photodetector outputs the second signal. When the value of (time L)/(time H) is within a predetermined range, the control unit determines that the first toner cartridge 28 is a genuine product recommended by the manufacturer. When the value of (time L)/(time H) is out of the predetermined range, the control unit determines that the first toner cartridge 28 is not a genuine product. The result of the determination by the control unit is displayed on the control panel of the image forming apparatus 1.

According to the embodiment, the cartridge body 35 of the first toner cartridge 28 has the first and second toner housing portions 50*a* and 50*b*. The first and second toner housing portions 50*a* and 50*b* extend in the direction of the long axis L1 of the cartridge body 35 and are arranged in the direction of the short axis S1. Therefore, the first toner cartridge 28 employs a configuration in which two conventional cylindrical cartridges are arrayed. The quantity of toner filling is thus doubled.

Moreover, in the cartridge body 35 of the first toner cartridge 28, the height at the position corresponding to the second toner housing portion 50*b* (depth D2) is larger than the height at the position corresponding to the first toner housing portion 50*a* (depth D1).

Thus, even when the cartridge housing portion 27 in which the first toner cartridge 28 is inserted is limited in height, a sufficient quantity of toner filling can be secured. Therefore, the frequency of replacement of the first toner cartridge 28 can be reduced and maintenance of the image forming apparatus 1 is made easier.

Meanwhile, in the first toner cartridge 28 according to the embodiment, the first stirring member 70 and the second stirring member 71 rotate synchronously with each other as the first gear 72 fixed to the rotary shaft 74 and the second gear 73 fixed to the rotary shaft 79 mesh with each other. Since the first and second gears 72 and 73 are common components of the same size, the distance X between the first stirring member 70 and the second stirring member 71 is fixed.

In the first toner cartridge 28 having such a configuration, if the depth D1 of the first toner housing portion 50*a* and the depth D2 of the second toner housing portion 50*b* are equivalent, the quantity of toner filling can be increased further.

To realize this, the first bottom part 51*a* of the first toner housing portion 50*a* must be lowered to a position equivalent to the second bottom part 51*b* of the second toner housing portion 50*b*, and also the position of the first stirring member 70 must be lowered to correspond to the position of the first bottom part 51*a*. However, since the screw 63 is situated right below the outer circumferential part of the first stirring member 70, lowering the first stirring member 70 causes a problem that the paddle unit 75 and the screw 63 interfere with each other.

Moreover, the height of the first protrusion 60 serving as a partition between the first bottom part 51*a* and the third bottom part 54 cannot be secured. Therefore, the boundary between the toner carrying portion 52 and the bottom of the first toner housing portion 50*a* becomes unclear, and toner that is delivered along the toner carrying portion 52 when the screw 63 rotates, escapes to the first toner housing portion 50*a*. This obstructs smooth carrying of toner even though the quantity of toner filling can be increased. Therefore, toner cannot be efficiently supplied to the first image forming unit 16.

On the other hand, in the above embodiment, since only the second bottom part 51*b* of the second toner housing portion 50*b* is lowered, the first stirring member 70 and the screw 63 do not interfere with each other. Moreover, since the difference in height between the first bottom part 51*a* and the third bottom part 54 can be maintained, the height of the first protrusion 60 serving as a partition between the bottom of the first toner housing portion 50*a* and the toner carrying portion 52 can be secured.

Therefore, when the screw 63 rotates to carry toner, the toner can be prevented from escaping to the first toner housing portion 50*a*. The toner in the toner carrying portion 52 can be efficiently guided to the toner discharge port 55.

Thus, in the first toner cartridge 28 in which the screw 63 is situated between the bottom of the first toner housing portion 50*a* and the bottom of the second toner housing portion 50*b*, the quantity of toner filling can be increased without obstructing the carrying of toner. This can reduce the frequency of replacement of the first toner cartridge 28.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A toner cartridge comprising:

a first toner housing portion configured to house toner, the first toner housing portion having a first bottom part that is curved;

a second toner housing portion configured to house toner, the second toner housing portion having a second bottom part that is curved;

a groove provided between the first toner housing portion and the second toner housing portion, wherein the first toner housing portion and the groove are partitioned by a first partition provided at the first bottom part, the second bottom part and the groove are partitioned by a second partition provided at the second bottom part;

a screw that is provided on the groove and configured to rotate in the groove;

a first mixer provided on the first toner housing portion, the first mixer configured to stir toner along the first bottom part; and a second mixer provided on the second toner housing portion, the second mixer configured to stir toner along the second bottom part, wherein a lowest part of the second bottom part is at a lower position than a lowest part of the first bottom part relative to a center of rotation of the screw and the second partition is at a higher position than the first partition relative to the groove.

2. The toner cartridge of claim 1, wherein the height of the second partition is taller than the height of the first partition.

3. The toner cartridge of claim 1, wherein the first mixer and the second mixer carry stirred toner toward the screw.

4. The toner cartridge of claim 3, wherein the groove having a bottom part where a toner discharge port is provided, the screw carries toner towards the toner discharge port.

5. The toner cartridge of claim 4, wherein the bottom part of the groove is curved to follow a rotation locus drawn by the screw.

6. The toner cartridge of claim 1, wherein the first partition prescribes a boundary between the first bottom part of the first toner housing portion and the groove.

7. The toner cartridge of claim 1, wherein the second partition prescribes a boundary between the second bottom part of the second toner housing portion and the groove.

8. The toner cartridge of claim 1, wherein the first bottom part of the first toner housing portion is curved to follow a rotational locus drawn by the first mixer and the second bottom part of the second toner housing portion is curved to follow a rotational locus drawn by the second mixer.

9. The toner cartridge of claim 1, further comprising a cartridge body having the first toner housing portion, the second toner housing portion and the groove, the cartridge body including a container having an opening facing the first and second bottom parts of the first and second toner housing portions and the groove, and a top cover that closes the opening of the container.

10. The toner cartridge of claim 9, wherein a depth of the first toner housing portion is prescribed between an inner surface of the top cover and the lowest part of the first bottom part, a depth of the second toner housing portion is prescribed between the inner surface of the top cover and the lowest part of the second bottom part.

11. An image forming apparatus comprising:

an image forming unit having a developing device; and a toner cartridge that supplies toner to the developing device, the toner cartridge includes:

a first toner housing portion configured to house toner, the first toner housing portion having a first bottom part that is curved;

a second toner housing portion configured to house toner, the second toner housing portion having a second bottom part that is curved;

a groove provided between the first toner housing portion and the second toner housing portion, wherein the first toner housing portion and the groove are partitioned by a first partition provided at the first bottom part, the second bottom part and the groove are partitioned by a second partition provided at the second bottom part;

a screw that is provided on the groove and configured to rotate in the groove;

a first mixer provided on the first toner housing portion, the first mixer configured to stir toner along the first bottom part; and a second mixer provided on the second toner housing portion, the second mixer configured to stir toner along the second bottom part, wherein a lowest part of the second bottom part is at a lower position than a lowest part of the first bottom part relative to a center of rotation of the screw and the second partition is at a higher position that the first partition relative to the groove.

* * * * *